US005301424A

United States Patent [19]

Snyder

[11] Patent Number: 5,301,424

[45] Date of Patent: Apr. 12, 1994

[54] METHOD FOR HYDRAULICALLY EXPANDING TUBULAR MEMBERS

[75] Inventor: David A. Snyder, North Huntingdon, Pa.

[73] Assignee: Westinghouse Electric Corp., Pittsburgh, Pa.

[21] Appl. No.: 986,151

[22] Filed: Nov. 30, 1992

[51] Int. Cl.[5] ..... B23P 15/26

[52] U.S. Cl. ..... 29/890.044; 29/890.043; 29/727

[58] Field of Search ..... 29/726, 727, 523, 890.043, 29/890.044; 72/58; 279/2.08, 2.22

[56] References Cited

U.S. PATENT DOCUMENTS

| | | | |
|---|---|---|---|
| 4,079,701 | 3/1978 | Hickman et al. . | |
| 4,159,564 | 7/1979 | Cooper, Jr. . | |
| 4,194,284 | 3/1980 | Diels et al. . | |
| 4,195,390 | 4/1980 | Amen . | |
| 4,213,236 | 7/1980 | Diels et al. . | |
| 4,397,173 | 8/1983 | Eftefield et al. . | |
| 4,398,875 | 8/1983 | Kawashima et al. . | |
| 4,407,150 | 10/1983 | Kelly | 29/727 |
| 4,420,866 | 12/1983 | Mueller . | |
| 4,513,497 | 4/1985 | Finch | 29/727 |
| 4,513,506 | 4/1985 | Vogeleer . | |
| 4,616,392 | 10/1986 | Snyder . | |
| 4,694,677 | 9/1987 | Rabe . | |
| 4,724,595 | 2/1988 | Snyder . | |
| 4,779,445 | 10/1988 | Rabe . | |
| 4,889,679 | 12/1989 | Snyder et al. . | |
| 4,901,551 | 2/1990 | Widart | 29/727 |

FOREIGN PATENT DOCUMENTS

| | | | |
|---|---|---|---|
| 0066871 | 12/1982 | European Pat. Off. | 29/727 |
| 1135563 | 1/1985 | U.S.S.R. | 279/2.08 |
| 1256881 | 9/1986 | U.S.S.R. | 279/2.08 |
| 1535676 | 1/1990 | U.S.S.R. | 279/2.08 |

*Primary Examiner*—Irene Cuda

*Attorney, Agent, or Firm*—Walter S. Stevens

[57] ABSTRACT

System and method for hydraulically expanding tubular members, such as heat transfer tubes and sleeves of the type found in nuclear steam generators. The system includes a resilient ribbed bladder for radially expanding the tube or tubular sleeve that is to be disposed in the tube. The system further includes a pressurizer hydraulically connected to the bladder for supplying pressurized hydraulic fluid to the bladder in order to expand the bladder into intimate engagement with the sleeve and/or tube. The system also includes a controller electrically connected to the pressurizer for controllably operating the pressurizer. The system may further include a fluid supply reservoir fluidly connected to the pressurizer for supplying fluid to the pressurizer and may also include visual display means electrically connected to the controller for displaying the pressure acting on the bladder during the expansion process. The ribbed structure of the bladder allows the bladder to radially expand over a larger diameter without rupture of the bladder and also allows the bladder to expand relatively short axial sections of the tube and/or sleeve.

11 Claims, 12 Drawing Sheets

METHOD FOR HYDRAULICALLY EXPANDING TUBULAR MEMBERS

BACKGROUND OF THE INVENTION

This invention generally relates to apparatus and methods for expanding tubular members and more particularly relates to a system and a method for hydraulically expanding heat transfer tubes and sleeves of the type found in nuclear steam generators.

Although devices and methods for expanding nuclear steam generator tubes and sleeves are known, it has been observed that these devices and methods have a number of operational problems associated with them. However, before these problems can be appreciated, some background is necessary as to the structure and operation of a typical nuclear steam generator.

In this regard, a typical nuclear steam generator generates steam when heat is transferred from a heated and radioactive primary fluid to a non-radioactive secondary fluid of lower temperature. The primary fluid flows through a plurality of U-shaped tubes (i.e., a tube bundle), which are received through holes in a plurality of support plates and holes in a tubesheet, which support plates and tubesheet are disposed in the steam generator. The secondary fluid flows across the exterior surfaces of the tubes as the primary fluid flows through the tubes. The walls of the tubes function as heat conductors for transferring heat from the heated primary fluid flowing through the tubes to the secondary fluid of lower temperature flowing across the exterior surfaces of the tubes.

Because the primary fluid is radioactive, the steam generator is designed such that the radioactive primary fluid flowing through the tubes does not radioactively contaminate the nonradioactive secondary fluid flowing across the exterior surfaces of the tubes. Radioactive contamination of the secondary fluid is undesirable for safety reasons. Therefore, the tubes are designed to be leak-tight so that the radioactive primary fluid remains separated from the nonradioactive secondary fluid to avoid commingling the primary fluid with the secondary fluid.

Occasionally, due to tube wall intergranular cracking caused by stress and corrosion during operation (i.e., known in the art as primary water stress corrosion cracking), the steam generator tubes may degrade (i.e., experience tube wall thinning) and thus may not remain leak-tight. If through-wall cracking occurs due to the degradation, the radioactive primary fluid may commingle with the nonradioactive secondary fluid. However, if degradation is suspected, the tube, although degraded, may remain in service by sleeving the degraded portion of the tube. When sleeving is performed, a tubular sleeve is inserted into the tube to cover the degraded portion of the tube. The sleeve is then secured to the tube by radially expanding portions of the sleeve into intimate engagement with the inner wall of the tube, such that the degraded portion of the tube is spanned or covered. In this manner, the radioactive primary fluid is prevented from commingling with the non-radioactive secondary fluid even though the wall of the tube is degraded.

Moreover, during operation of the steam generator the tubes may experience undesirable large-amplitude vibration due to the energy absorbed by the tubes from impingement of the high-velocity secondary fluid on the exterior surfaces of the tubes, such as may occur in postulated accident conditions (e.g., loss of coolant accident) during operation of the steam generator. Such tubes can become unstable due to these relatively large vibration amplitudes. Unless mitigated, these vibration amplitudes may generate sufficient levels of bending stress to enhance the initiation and propagation of any degradation that may be present in the wall of the tube. The combined vibration and degradation may cause the tube to sever, thereby commingling the primary fluid with the secondary fluid. The severed unsupported tube ends are also then free to impact against and damage adjacent tubes. Thus, if this were to occur, the tube ends may swirl in the flowing fluid field and impact neighboring undamaged tubes in the tube bundle with force sufficient to damage these neighboring tubes in which primary fluid is still flowing. The walls of these neighboring tubes may thereby become breached and allow the radioactive primary fluid to radioactively contaminate the non-radioactive secondary fluid. Therefore, to mitigate such large-amplitude vibration, some or all of the tubes may be radially expanded into engagement with its surrounding support plates or tube sheet in order to stabilize the tube so that the tube will not experience large-amplitude vibration, even during postulated accident conditions.

Both sleeving and stabilization of the tubes may be obtained by radial expansion of the tubes and/or sleeves. That is, such sleeving or stabilization is performed by either expansion of a sleeve into engagement with the inner wall of the tube for sleeving the tube or expansion of the tube itself into engagement with its surrounding support plates or tubesheet to mitigate vibration of the tube.

However, the required length of the expansion zone of the tube and/or sleeve in the axial direction may be relatively short (e.g., less than or equal to approximately 0.6 inches). Such a short axial length is present between the U-bend region of each tube and the top surface of the uppermost support plate. Applicant has discovered that prior art devices have proven unsatisfactory for expanding such short axial lengths. For example, such prior art devices fail after repeated use because the short axial length of the expansion member belonging to such devices lack sufficient strength and resiliency to withstand the relatively greater radial pressure required to expand the tube over a short axial length.

Devices for expanding tubes are known. One such device is disclosed by U.S. Pat. No. 4,724,595 issued Feb. 16, 1988 in the name of David A. Snyder entitled "Bladder Mandrel For Hydraulic Expansions Of Tubes And Sleeves" and assigned to the assignee of the present invention. However, this Snyder patent does not appear to disclose a system and method for suitably expanding relatively short axial sections of tubing.

Another device for expanding tubes is disclosed in U.S. Pat. No. 4,159,564 issued Jul. 3, 1979 in the name of Frank W. Cooper, Jr. entitled "Mandrel For Hydraulically Expanding A Tube Into Engagement With A Tubesheet" and assigned to the assignee of the present invention. However, the Cooper, Jr. patent does not appear to disclose a system and method for suitably expanding relatively short axial sections of tubing.

Hence, although devices and methods for expanding tubes are known in the art, the prior art does not appear to disclose a system and method for hydraulically expanding tubular members, wherein the required axial length of the expansion zone for the tubular member may be relatively short.

Therefore, what is needed is a system and method for hydraulically expanding tubular members, wherein the required axial length of the expansion zone for the tubular member may be relatively short.

SUMMARY OF THE INVENTION

Disclosed herein are a system and a method for hydraulically expanding tubular members, such as heat transfer tubes and sleeves of the type found in nuclear steam generators. The system comprises a resilient ribbed bladder for radially expanding the tube or sleeve that is disposed in the tube. The system further comprises a pressurizer hydraulically connected to the bladder for supplying pressurized hydraulic fluid to the bladder in order to expand the bladder into intimate engagement with the sleeve and/or tube. The system also comprises a controller electrically connected to the pressurizer for controllably operating the pressurizer. The system may further include a fluid supply reservoir fluidly connected to the pressurizer for supplying fluid to the pressurizer and may also include visual display means electrically connected to the controller for displaying the pressure acting on the bladder during the expansion process. The ribbed structure of the bladder allows the bladder to radially expand over a larger diameter without rupture of the bladder and also allows the bladder to expand relatively short axial sections of the tube and/or sleeve.

An object of the present invention is to provide a system and method for hydraulically expanding tubular members, such as heat transfer tubes and sleeves of the type found in nuclear steam generators.

Another object of the present invention to provide a system and method for obtaining an expansion zone in the tube and/or sleeve, which expansion zone may have a relatively short axial length.

A feature of the present invention is the provision of a ribbed bladder that is capable of radially expanding without rupture of the bladder to obtain an expansion zone having a predetermined diameter and a relatively short axial length.

An advantage of the present invention is that due to the ribbed structure of the bladder, the bladder can be repeatedly expanded and contracted without rupture.

Another advantage of the invention is that the bladder is easily insertable into the tube and/or sleeve without the need for lubricants to lessen friction.

Yet another advantage of the invention is that due to the ribbed structure of the bladder, the bladder is capable of withstanding relatively high hydraulic expansion pressures.

Still another advantage of the invention is that radiation exposure to maintenance personnel during sleeving operations is reduced because the system is capable of rapidly sleeving tubes.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENTS

Disclosed hereinbelow is a system and method for hydraulically expanding tubular members, such as heat transfer tubes and sleeves of the type found in nuclear steam generators.

Figure 1:
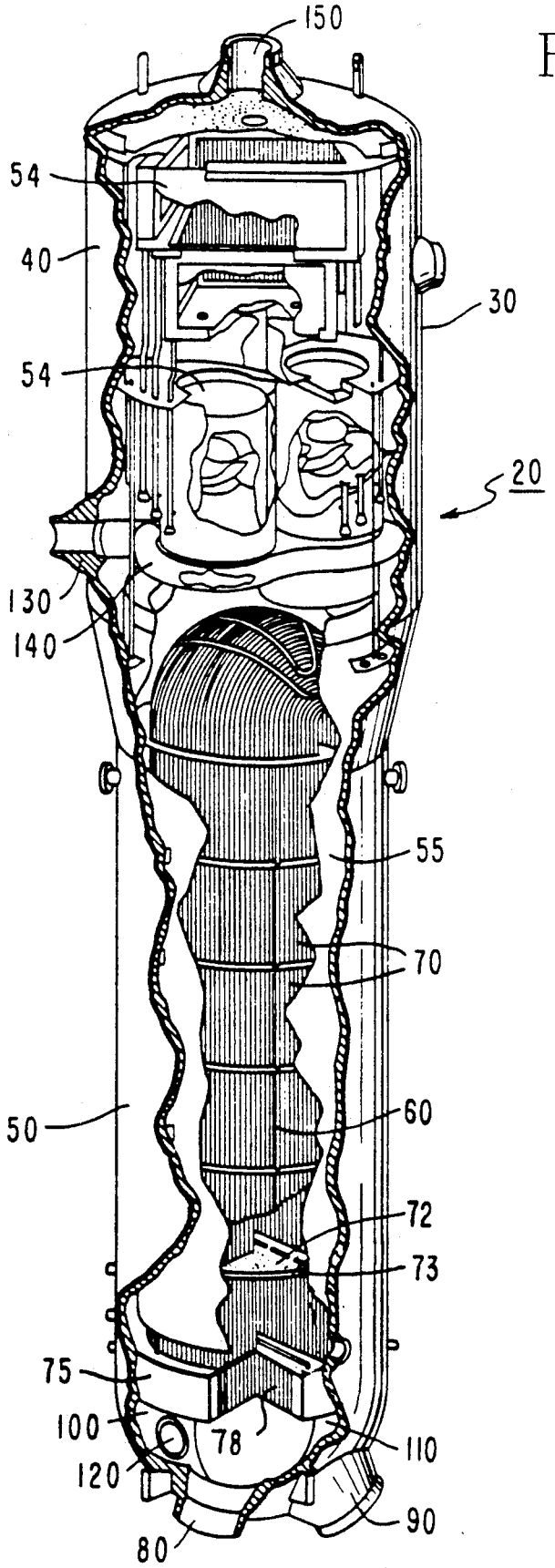
FIG. 1 shows in partial elevation a typical nuclear steam generator with parts removed for clarity, the steam generator having a plurality of U-shaped heat transfer tubes disposed therein.

Referring to FIG. 1, there is shown a typical nuclear steam generator, generally referred to as 20, for generating steam. Steam generator 20 comprises a generally cylindrical outer hull 30 having a generally cylindrical upper portion 40 and a generally cylindrical lower portion 50. Disposed in upper portion 40 is moisture separating means 54 for separating a steam-water mixture (not shown). Disposed in lower portion 50 is an inner hull 55 which is closed at its top end except for a plurality of openings in its top end for allowing passage of the steam-water mixture from inner hull 55 to moisture separating means 54. Disposed in inner hull 55 is a vertical steam generator tube bundle 60 defined by a plurality of vertical U-shaped steam generator tubes 70 that extend through holes 72 formed in a plurality of horizontally disposed support plates 73. Each tube 70 has an inner wall 74 (see FIG. 2). As shown in FIG. 1, disposed in lower portion 50 and attached thereto is a tube sheet 75 having a plurality of apertures 78 therethrough for receiving the ends of each tube 70. Disposed on outer hull 30 are a first inlet nozzle 80 and a first outlet nozzle 90 in fluid communication with an inlet plenum chamber 100 and with an outlet plenum chamber 110, respectively. A plurality of manway holes 120 are formed through outer hull 30 below tube sheet 75 for providing access to inlet plenum chamber 100 and outlet plenum chamber 110. Moreover, formed through outer hull 30 above tube bundle 60 is a second inlet nozzle 130, which is connected to a perforated feedring 140 disposed in upper portion 40 for allowing entry of non-radioactive secondary fluid (not shown) into upper portion 40. The secondary fluid, which may be demineralized water, will flow into upper portion 40 through inlet nozzle 130 and the perforations (not shown) of feedring 140. A second outlet nozzle 150 is disposed on the top of upper portion 40 for exit of steam from steam generator 20.

During operation of steam generator 20, radioactive heated primary fluid, such as demineralized water, enters inlet plenum chamber 100 through first inlet nozzle 80 and flows through tubes 70 to outlet plenum chamber 110 where the primary fluid exits steam generator 20 through first outlet nozzle 90. As the primary fluid enters inlet plenum chamber 100, the secondary fluid simultaneously enters feedring 140 through second inlet nozzle 130 and flows downwardly from the perforations of feedring 140. A portion of this secondary fluid vaporizes into a steam-water mixture due to conductive heat transfer from the primary fluid to the secondary fluid through the walls of tubes 70 which comprise bundle 60. The steam-water mixture flows upwardly from bundle 60 and is separated by moisture separating means 54 into saturated water and dry saturated steam. Thus, as the secondary fluid enters feedring 140, the saturated water returns downwardly to bundle 60 and the dry saturated steam rises upwardly to exit steam generator 20 through second outlet nozzle 150. Moreover, the primary fluid is radioactive; therefore, for safety reasons, steam generator 20 is designed such that the primary fluid is nowhere in direct fluid communication with the secondary fluid in order that the secondary fluid is not radioactively contaminated by commingling with the primary fluid. The structure and operation of such a typical nuclear steam generator is more fully described in U.S. Pat. No. 4,079,701 entitled "Steam Generator Sludge Removal System" issued Mar. 21, 1978 in the name of Robert A. Hickman, et al., the disclosure of which is hereby incorporated by reference.

Occasionally, due to tube wall intergranular cracking, some of the tubes 70 may degrade and thus may not remain leak-tight. If degradation is suspected, the tube, although degraded, may remain in service by sleeving the degraded portion of the tube. Moreover, in the case of postulated accident conditions (e.g., loss of coolant accident) that might occur during operation of steam generator 20, the tubes 70 may experience undesirable large-amplitude vibration due to the energy absorbed by the tubes from impingement of the high-velocity (e.g., approximately 25 feet per second) secondary fluid on the exterior surfaces of tubes 70. Such vibration may be mitigated by stabilizing the tube 70. As disclosed in detail hereinbelow, the system and method of the invention is capable of sleeving and stabilizing such tubes.

Figure 2:
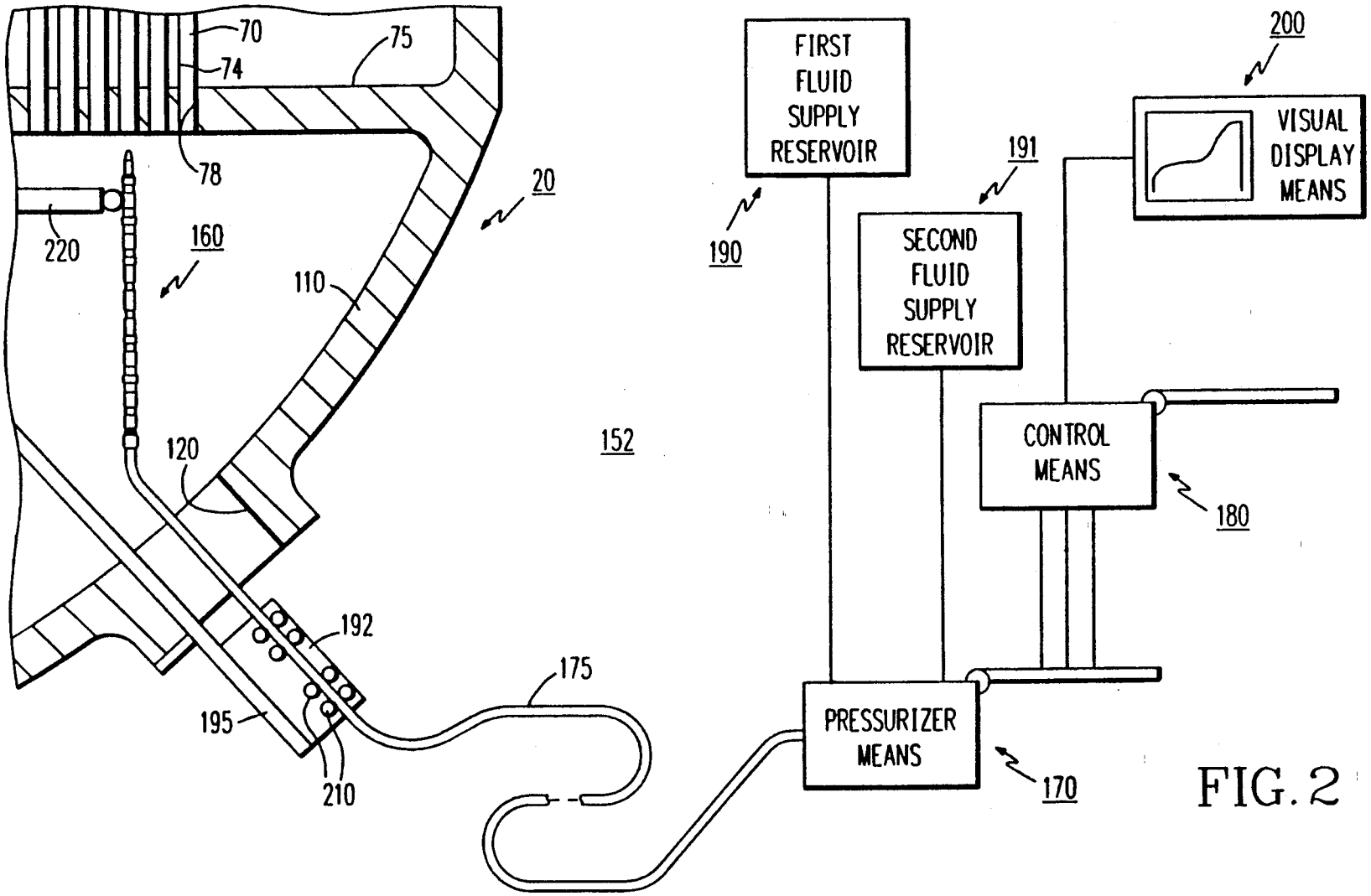
FIG. 2 illustrates the system of the invention in operative condition for sleeving and/or stabilizing a selected one of the tubes.

Therefore, referring to FIG. 2, there is shown the subject matter of the present invention, which is a system, generally referred to as 152, for hydraulically expanding heat transfer tubes 70 and/or sleeves of the kind typically found in a heat exchanger, such as nuclear steam generator 20, in order to sleeve and/or stabilize tube 70. System 152 comprises expansion means, generally referred to as 160, for expanding a selected tube 70 and/or a tubular sleeve 155 inserted into tube 70. Sleeve 155 has an inner wall 157 (see FIG. 3) and is sized to be slidably received in tube 70. As shown in FIG. 2, the system further comprises pressurizer means 170 hydraulically connected, such as by a flexible conduit 175, to expansion means 160 for supplying hydraulic fluid to expansion means 160 in order to expand expansion means 160. The hydraulic fluid contemplated herein is water, but also may be a suitable oil, or air. System 152 also comprises control means 180 electrically connected to pressurizer means 170 for controllably operating pressurizer means 170. The system 152 of the invention may further include a first and second fluid supply reservoir 190 and 191, respectively, fluidly connected to pressurizer means 170 for supplying fluid to pressurizer means 170 and in addition may include visual display means 200 electrically connected to control means 180 for visually displaying the amount of pressure acting on expansion means 160 as a function of time during the expansion process.

Still referring to FIG. 2, a conduit pusher/puller mechanism 192 may also be provided to engage conduit 175, such as by rotatable wheels 210, for pushing and pulling conduit 175. It will be appreciated that pushing conduit 175 advances expansion means 160 along the longitudinal axis of tube 70 and/or sleeve 155 and pulling conduit 175 withdraws expansion means 160 along the longitudinal axis of tube 70 and/or sleeve 155 because conduit 175 is connected to expansion means 160. Pusher/puller mechanism 192 may be connected to manway 120, such as by means of a removable bracket 195. Moreover, a guide mechanism 215 is also provided for engaging expansion means 160 and conduit 175, so that expansion means 160 may be precisely axially aligned with the longitudinal axis of tube 70 and/or sleeve 155 and suitably guided into and out-of tube 70 and/or sleeve 155.

Figure 3:
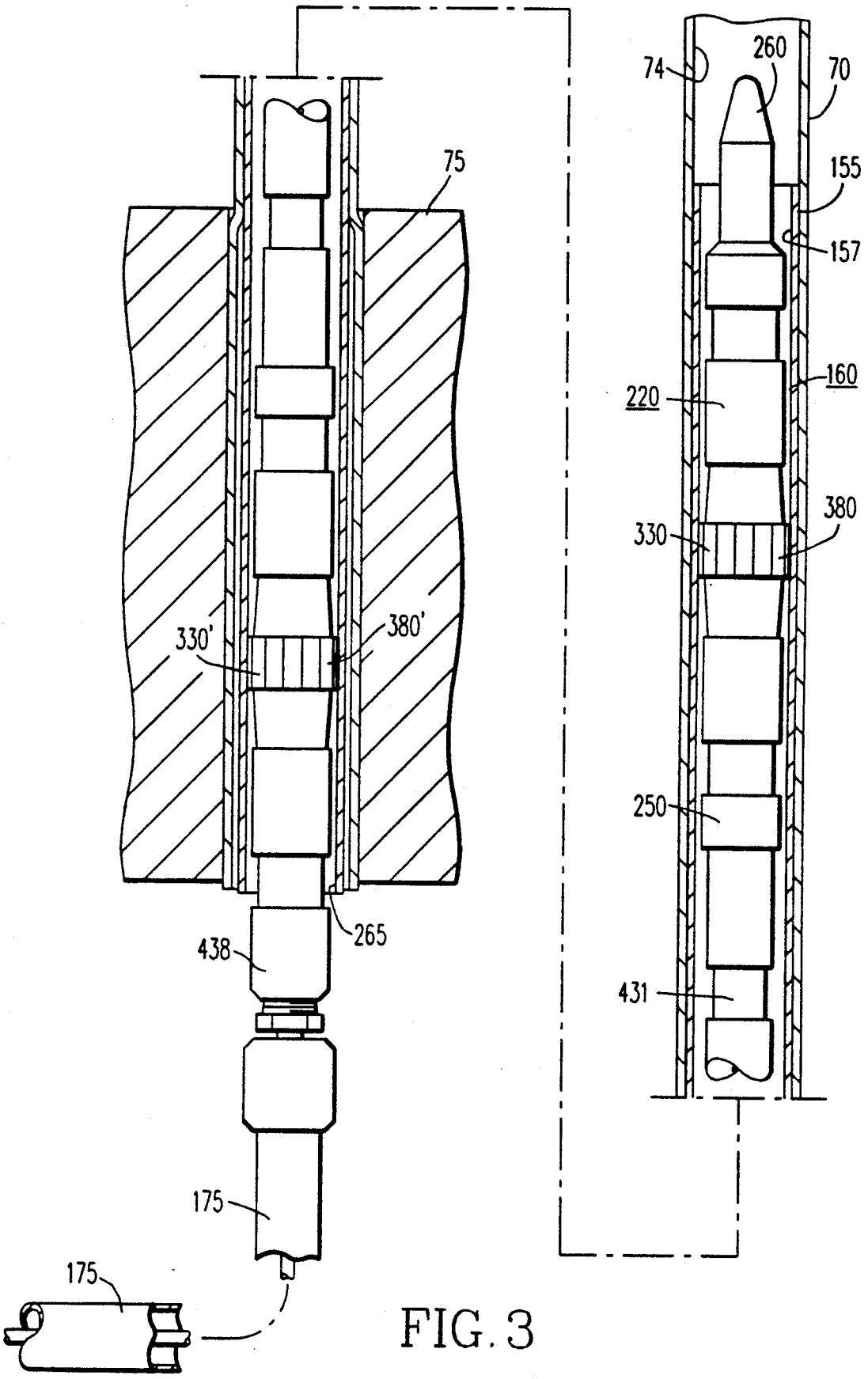
FIG. 3 shows in elevation a support body supporting a ribbed bladder thereon capable of being pressurized to expand a sleeve into intimate engagement with the inside wall of a preselected tube, the bladder being disposed in the sleeve which is in turn disposed in the preselected tube for sleeving the tube.
Figure 4:
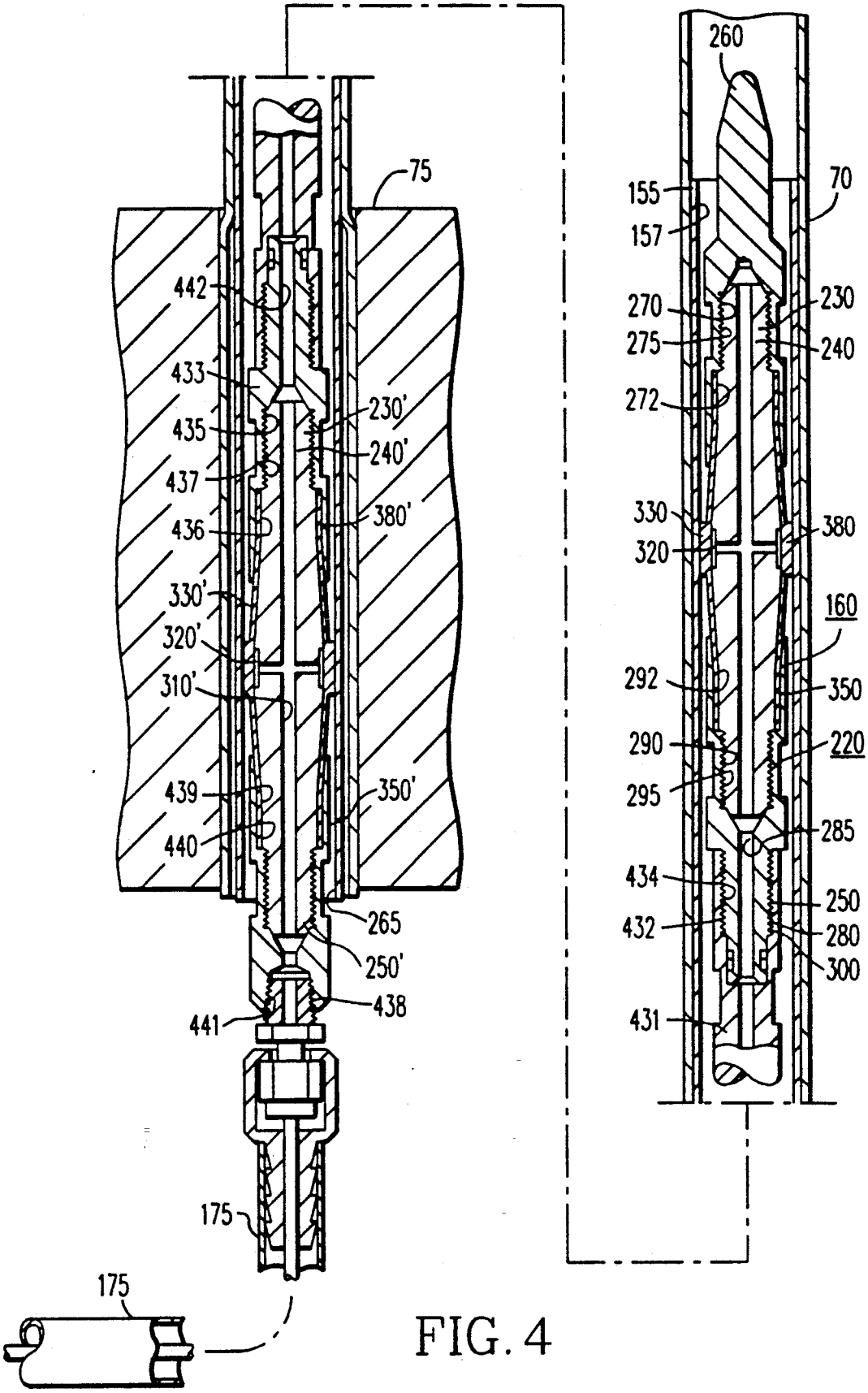
FIG. 4 shows in vertical section, the support body and unexpanded bladder disposed in the sleeve.

Referring now to FIGS. 3 and 4, sleeve 155 is there shown disposed in tube 70 for sleeving tube 70 so that a degraded portion (not shown) of tube 70 is spanned or covered by sleeve 155. The outside diameter of sleeve 155 is less that the inside diameter of tube 70 for defining a clearance between tube 70 and sleeve 155. Such a clearance allows sleeve 155 to be suitably inserted into and axially moved within tube 70 without binding in tube 70.

Referring again to FIGS. 3 and 4, disposed in sleeve 155 is expansion means 160 comprising an elongate generally cylindrical support body 220 sized to be received in sleeve 155. Support body 220 includes a generally cylindrical central body 230 having an externally threaded distal end portion 240 and an externally threaded proximal end portion 250. The term "proximal end portion" is defined herein to mean that portion of central body 230 disposed nearer pressurizer means 170 and the term "distal end portion" is defined herein to mean that portion of central body 230 disposed further away from pressurizer means 170 when expansion means 160 is disposed in tube 70 and/or sleeve 155. Threadably connected to distal end portion 240 is a rounded generally conical nose portion 260 for easily inserting support body 220 into the mouth 265 of sleeve 155 or into the open end of tube 70. Nose portion 260 has a step bore 270 defining an unthreaded portion 272 therein for reasons disclosed presently. Step bore 270 also has an internally threaded portion 275 of smaller diameter than unthreaded portion 272 for threadably engaging the external threads of distal end portion 240 of central body 230. In this manner, nose portion 260 is capable of being threadably connected to central body 230. In addition, threadably connected to proximal end portion 250 is a connector 280 having a step bore 290 defining an unthreaded portion 292 therein for reasons disclosed presently. Step bore 290 also has an internally threaded portion of smaller diameter than unthreaded portion 292 for threadably engaging the external threads of proximal end portion 250 of central body 230. In this manner, connector 280 is capable of being threadably connected to central body 230. In addition, connector 280 has a channel 285 therethrough for reasons disclosed presently. Moreover, connector 280 may have external threads 300 thereon for reasons provided hereinbelow.

Figure 5:
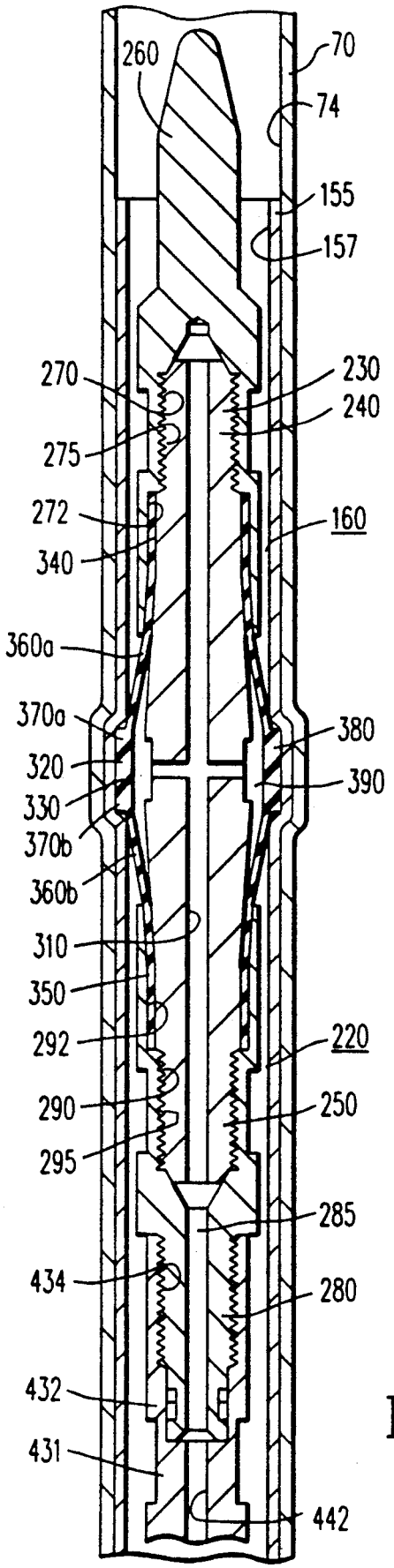
FIG. 5 shows in vertical section, the support body and the bladder in an expanded condition engaging the inside surface of the sleeve to radially expand the sleeve into engagement with the tube.

As best seen in FIG. 5, elongate central body 230 has a channel 310 extending generally longitudinally therethrough, channel 310 terminating in a port 320 on the exterior surface of central body 230 for conducting hydraulic fluid to the exterior surface of central body 230. Channel 310 is in communication with channel 285 of connector 280 for receiving fluid from channel 285. Surrounding central body 230 is a generally tubular bladder 330 which may be formed from a resilient thermo elastomer material, such as "PELLETHANE CPR-2103", available from The Upjohn Company, located in Torrance, Calif. Bladder 330 has an annular distal end neck portion 340 capable of being disposed in the unthreaded portion 272 of nose portion 260. Neck portion 350 has a wall thickness sized for it to be tightly sealingly interposed between central body 230 and nose portion 260, such sealing being obtained by a press fit. Bladder 330 also has an annular proximal end neck portion 350 capable of being disposed in the unthreaded portion 292 of connector 280. Neck portion 350 has a wall thickness sized for it to be tightly sealingly interposed between central body 230 and connector 280, such sealing being obtained by a press fit. In this manner, distal end neck portion 340 is sealingly connected to distal end portion 240 of central body 230 and proximal end neck portion 350 is sealingly connected to proximal end portion 250 of central body 230. Thus, bladder 330 is sealingly connected to central body 230 so that the interface between central body 230 and neck portions 340/350 of bladder 330 is leak-tight as bladder 330 is expansively pressurized by pressurizer means 170.

Figure 6:
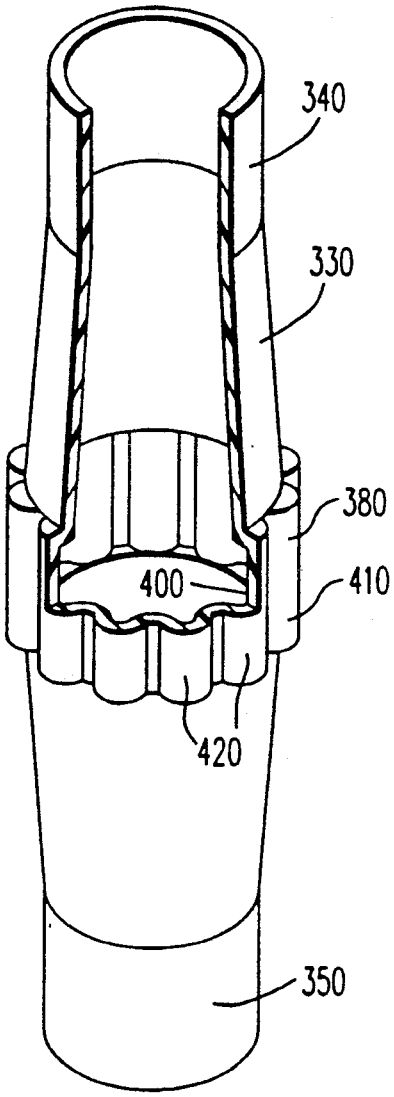
FIG. 6 is a perspective view in partial vertical section of the bladder.

Referring to FIGS. 5 and 6, bladder 330 includes a hollow generally frusto-conical or funnel-shaped distal shoulder portion **360*a* having its smaller diameter integrally formed with neck portion 340 and also includes a hollow generally frusto-conical or funnel-shaped proximal shoulder portion 360*b* having its smaller diameter integrally formed with neck portion 350. The larger diameters of shoulder portions 360*a* and 360*b* are integrally formed with proximal end portion 370*a* and distal end portion 370*b*, respectively, that belong to a generally tubular corrugated wall portion 380 of bladder 330. Thus, wall portion 380 is integrally formed with and interposed between shoulder portions 360*a*/360*b*. The longitudinal cross section profile of neck portions 340/350 and shoulder portions 360*a*/360*b* allow an expansion zone in tube 70 and/or sleeve 155 that has minimal residual stresses, as described more fully hereinbelow. Corrugated wall portion 380 surrounds a portion of central body 230 such that it covers port 320, which opens onto the exterior surface of central body 230. In this regard, bladder 330 surrounds central body 230 and covers port 320 so that a generally annular space 390 of variable volume is defined between central body 230 and resilient bladder 330**.

Still referring to FIGS. 5 and 6, corrugated wall portion 380 of bladder 330 has an inner surface 400 disposed over or covering port 320 and an outer surface 410 disposed adjacent the inner wall 157 of sleeve 155, which outer surface 410 of corrugated wall portion 380 is capable of intimately engaging inner wall 157 of sleeve 155 As described more fully hereinbelow, the corrugations of wall portion 380 form a plurality of adjacent, parallel, and generally rounded ribs 420 integrally formed in outer surface 410 of bladder 330 so that bladder 330 can expand a predetermined radial extent without rupture. Thus, ribs 420 extend parallel to the longitudinal axis of bladder 330 and are closely adjacently spaced around wall portion 380. It is important that wall portion 380 of bladder 330 be corrugated. This is important because the corrugations in wall portion 380 strengthen wall portion 380 so that wall portion 380 is capable of radially expanding without rupture to suitably engage inner wall 157 of sleeve 155 in order to suitably radially expand sleeve 155 and tube 70. As described in more detail presently, the corrugations of wall portion 380 increase the likelihood that bladder 330 can expand to a predetermined extent without rupture. In this regard, wall portion 380 is corrugated for maximizing elastic strength, for maximizing flexibility and radial growth potential, and for facilitating rapid recovery during contraction of the thermo elastomer material comprising bladder 330. Moreover, the corrugated wall portion 380 allows repeated high-pressure expansions of relatively large diametrical growth for bladder 330 without rupturing bladder 330. In addition, corrugated wall portion 380 allows the outside diameter of bladder 330 to be substantially less than a bladder having similar strength but not having corrugations. In this regard, the smaller diameter of bladder 330 necessarily increases the annular clearance between sleeve 155 and bladder 330. This is important because an increased clearance between sleeve 155 and bladder 330 allows support body 220 and its associated bladder 330 to be easily inserted into and withdrawn from tube 70 and/or sleeve 155 without frictional wear to tube 70, sleeve 155, or bladder 330 itself. The absence of frictional wear on bladder 330 extends the useful life of bladder 330.

Figure 7:
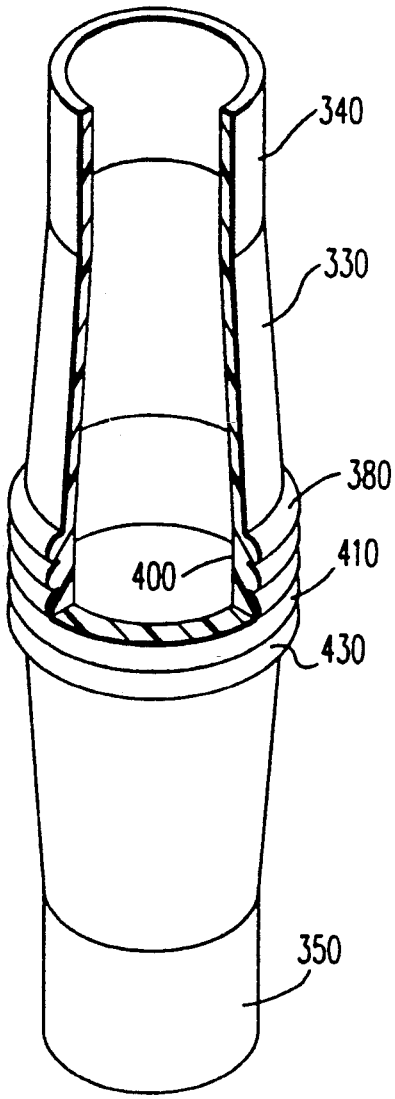
FIG. 7 is a perspective view in partial vertical section of an alternative embodiment of the bladder.

Referring to FIG. 7, an alternative embodiment of bladder 330 is shown having ribs 430 circumscribing wall portion 380. An advantage of this alternative embodiment is that it is capable of radially expanding tube 70 and/or sleeve 155 without substantially axially contracting tube 70 and/or sleeve 155 in the region of the expansion zone. Restricting the axial contraction of tube 70 provides a more oval-shaped expansion zone having sloping shoulders, when viewing a longitudinal cross section of the expansion zone. Providing an oval-shaped expansion zone minimizes the potential sites on the exterior surface of tube 70 where sludge can collect, so that the possibility of stress corrosion cracking of tube 70 is reduced.

Returning to FIGS. 3 and 4, expansion means 160 also comprises a generally cylindrical shank 431 having a distal end portion 432 and a proximal end portion 433. Formed in distal end portion 432 is an internally threaded bore 434 for threadably engaging external threads 300 of the distal end portion 280 belonging to central body 230. Formed in proximal end portion 433 of shank 431 is a step bore 435 defining an unthreaded portion 436 for reasons disclosed presently. Step bore 435 also defines a threaded portion 437 of smaller diameter than unthreaded portion 436 for threadably engaging the external threads of a proximal end portion 240' belonging to a central body 230' which is surrounded by a bladder 330'. Thus, it will be appreciated that the structure of central body 230' and bladder 330' is in all respects identical to the structure of central body 230 and bladder 330. Extending longitudinally through shank 431 is a channel 442 for conducting the hydraulic fluid through shank 431. Channel 442 is in fluid communication with channel 285 extending through connector 280 and also is in fluid communication with channel 310' extending through central body 230'. Expansion means 160 further comprises a generally cylindrical tail connector 438 having a step bore 439 therein defining an unthreaded portion 440 for receiving an annular proximal end neck portion 350' of bladder 330'. Step bore 439 also has an internally threaded portion of smaller diameter than unthreaded portion 440 for threadably engaging the external threads of proximal end portion 250' belonging to central body 230'. Extending through tail connector 438 is a bore 441 in fluid communication with channel 310' for conducting fluid into channel 310'.

Figure 8:
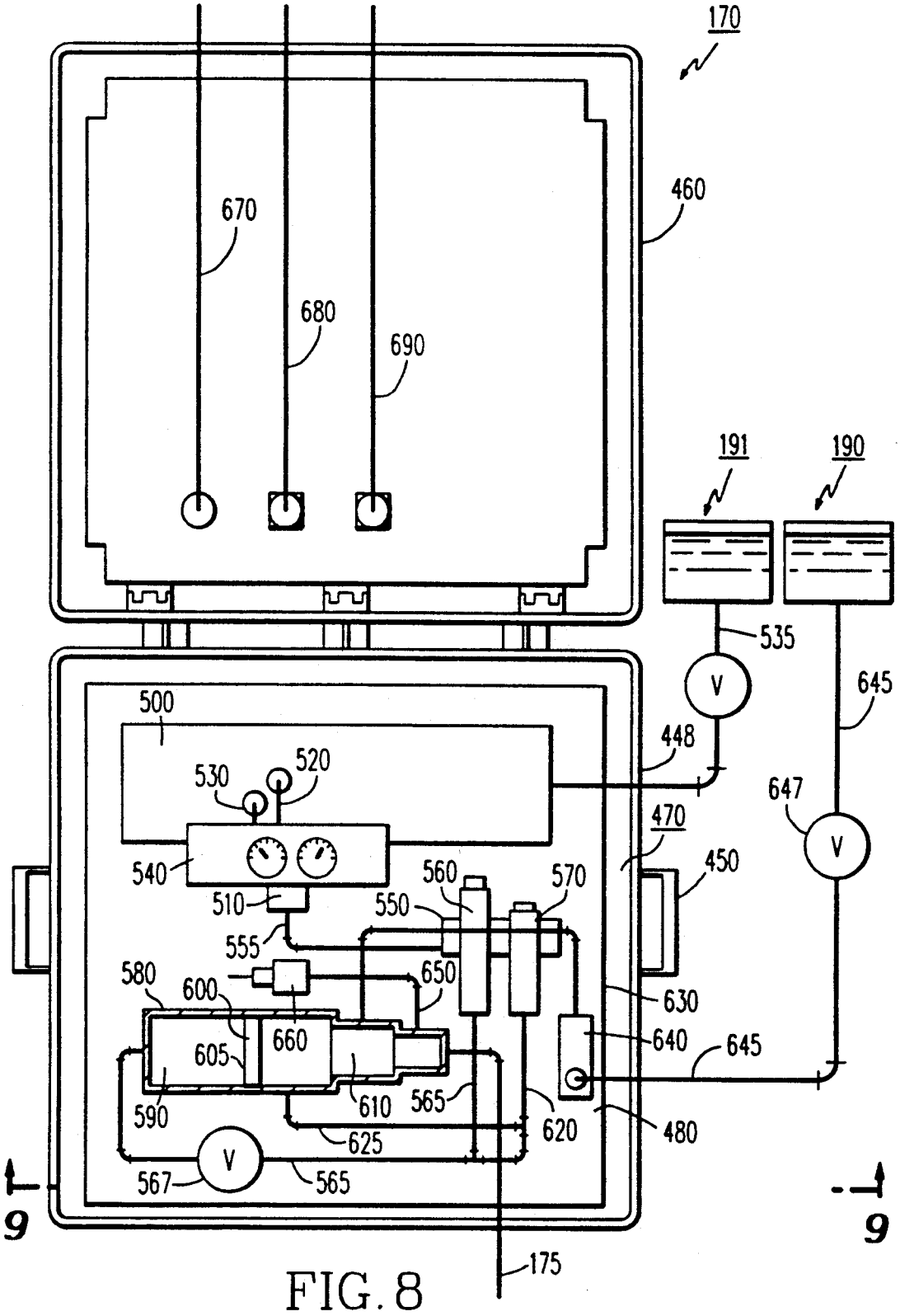
FIG. 8 is a plan view of pressurizer means for pressurizing the bladder.
Figure 9:
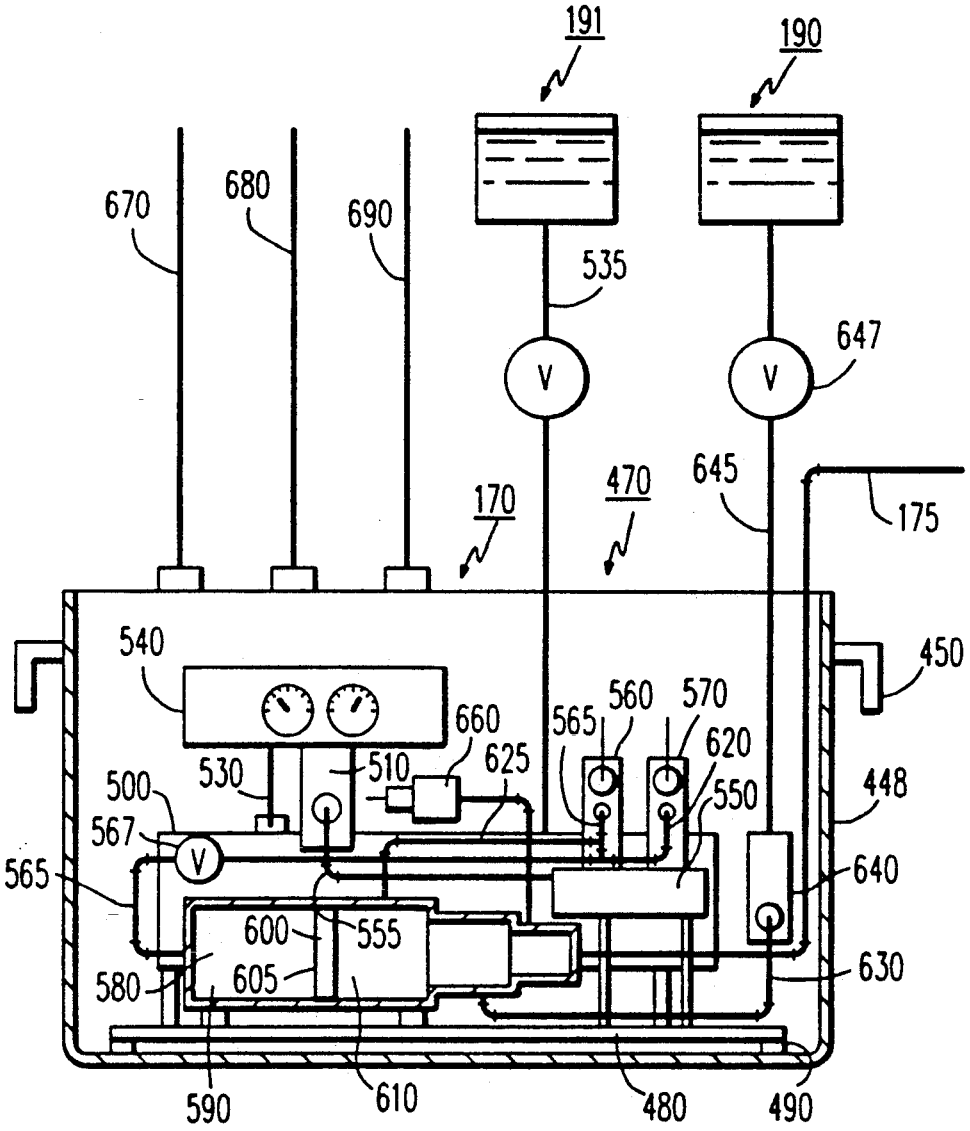
FIG. 9 is a view in partial vertical section of the pressurizer means taken along section line 9—9 of FIG. 8.

Turning now to FIGS. 8 and 9, pressurizer means 170 comprises a portable carrying case 448 having a plurality of handles 450 thereon for transporting pressurizer means 170 and a lid 460 attached thereto for closing carrying case 448, so that the internal components of pressurizer means 170 are protected from damage when pressurizer means 170 is being transported. The components of pressurizer means 170 will now be described. In this regard, disposed in carrying case 448 is a pressurizing assembly, generally referred to as 470, for pressurizing and depressurizing bladders 330/330'. Pressurizing assembly 470 comprises a support plate 480 attached, such as by support legs 490, to the bottom of carrying case 448. Attached to support plate 480 is a pump 500 for pumping the hydraulic fluid to a replaceable cartridge filter 510 which is hydraulically connected to pump 500 by a pipe 520. Filter 510 suitably filters the hydraulic fluid flowing therethrough to remove any undesired particulate matter from the fluid. It is important to remove any undesired particulate matter from the fluid so that conduit 175 and expansion means 160 are not fouled by such particulate matter. Hydraulically connected to pump 500, such as by a pipe 530, is a pressure gauge 540 for measuring and displaying the pressure generated by pump 500. Also hydraulically connected to pump 500, such as by pipe 535, is a second reservoir 191 containing a second hydraulic fluid, which may be a suitable oil. Pump 500 is capable of withdrawing the fluid from and returning the fluid to second reservoir 191, for reasons disclosed hereinbelow.

Still referring to FIGS. 8 and 9, filter 510 is hydraulically connected by a pipe 555 to a manifold block assembly 550. Manifold block assembly 550 includes a first solenoid control valve 560 and a second solenoid control valve 570 attached thereto for controlling the flow of the second hydraulic fluid to and from manifold block assembly 550, as disclosed in more detail presently. In this regard, first solenoid valve 560 is hydraulically connected by a pipe 565 to a pressure intensifier 580, which pressure intensifier 580 is capable of intensifying or increasing the pressure of the first hydraulic fluid disposed within it. For example, pressure intensifier 580 may be selected such that it is capable of increasing the hydraulic pressure of the first hydraulic fluid supplied to it by a multiple of fourteen. Pipe 565 has a flow control valve 567 for reasons described hereinbelow. Pressure intensifier 580 defines an internal first chamber 590 of predetermined volume, first chamber 590 having a piston 600 disposed therein capable of slidably advancing within first chamber 590, and which piston 600 includes a piston head 605 thereon. Pipe 565, which connects first solenoid valve 560 to pressure intensifier 580, is in fluid communication with first chamber 590 for supplying the second hydraulic fluid to piston head 605 to prepressurize the first hydraulic fluid in conduit 175. In this regard, as the second hydraulic fluid is supplied to piston head 605, piston 600 advances in first chamber 590 as piston head 605 is acted upon by the pressure of the second hydraulic fluid. Pressure intensifier 580 also defines an internal second chamber 610 of smaller volume than first chamber 590 for reasons disclosed presently. The pressure exerted on the first hydraulic fluid found in second chamber 610 is controllably intensified as piston 600 controllably moves in first chamber 590 because second chamber 610 is of smaller volume than first chamber 590. Moreover, second solenoid valve 570 is hydraulically connected by a pipe 620 to pipe 565 for supplying the second hydraulic fluid to first chamber 590. Pipe 620 is also hydraulically connected to first chamber 590 via pipe 625 for supplying the second hydraulic fluid to first chamber 590 in order to return piston 600 to its original position. That is, as control valve 567 is caused to close, the second hydraulic fluid flows through pipe 620 and pipe 625 to first chamber 590 such that piston 600 is acted upon by hydraulic pressure to return piston 600 to its original position. In addition, second chamber 610 is hydraulically connected by pipe 630 to an adaptor fitting 640 for supplying the first hydraulic fluid from adaptor fitting 640 to second chamber 610. A conduit 645 is removably connected to adaptor fitting 640 for supplying the first hydraulic fluid from first reservoir 190 to adaptor fitting 640. In addition, removably hydraulically connected to conduit 645 is first reservoir 190 for supplying the first hydraulic fluid into conduit 645. Hydraulically connected to second chamber 610 by pipe 650 is a pressure transducer 660, which is in turn electrically connected to control means 180, for detecting the pressure in second chamber 610 and converting the pressure detected therein into measurable electrical impulses. Moreover, electrically connected to pressurizing assembly 470 is a first cable 670 for supplying electric power to pump 500 to operate pump 500 and a second cable 680 for controlling (i.e., opening and closing) solenoid valves 560 and 570. In addition, electrically connected to pressurizer assembly 470 is a third cable 690 for conducting the electrical impulses from pressure transducer 660 to control means 180.

Figure 10:
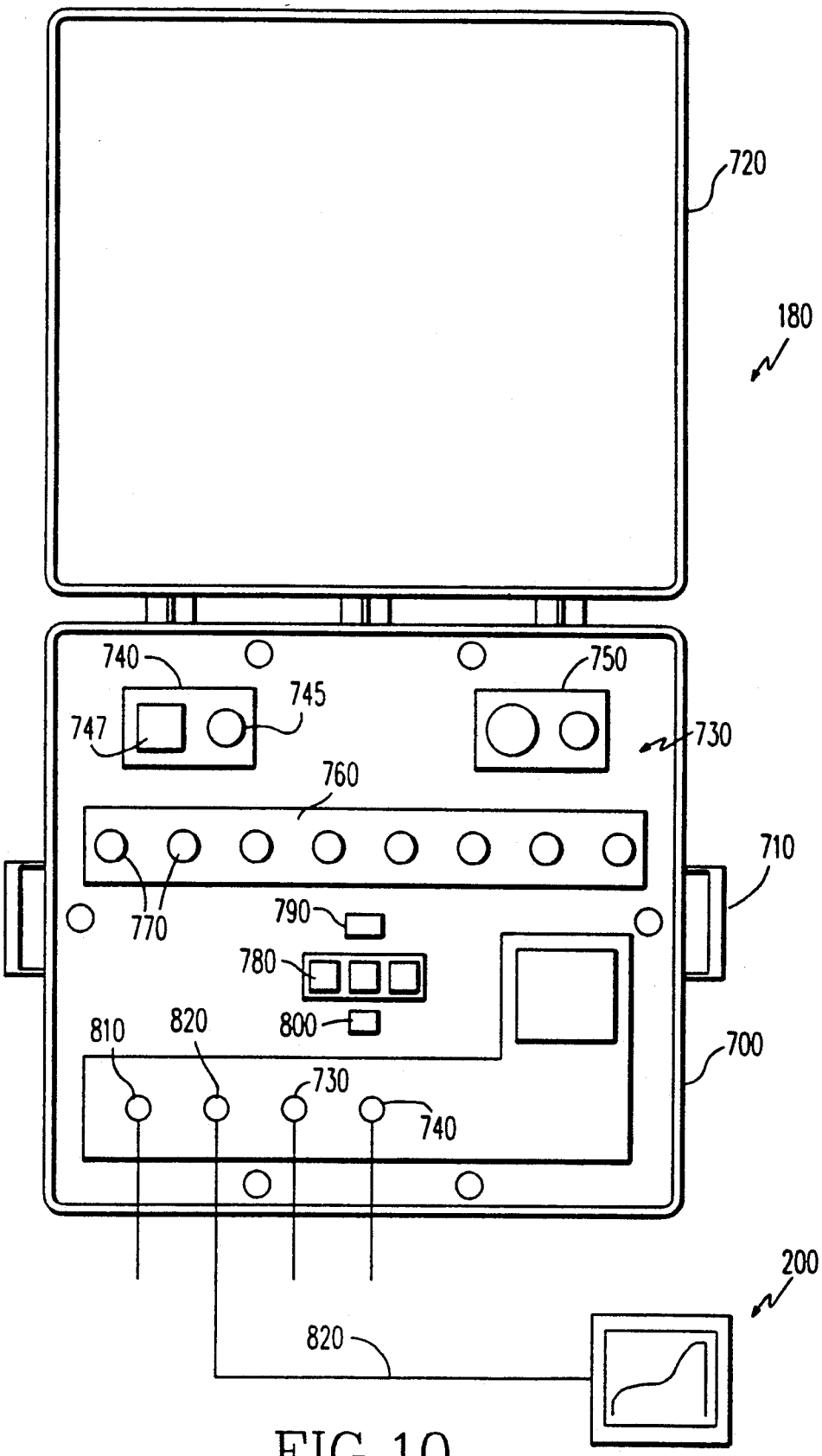
FIG. 10 is a plan view of control means for controlling the pressurizer means.

Referring to FIG. 10, control means 180 comprises a portable carrying case 700 having a plurality of handles 710 thereon for transporting control means 180 and a lid 720 attached thereto for closing carrying case 700, so that the internal components of control means 180 are protected from damage when control means 180 is being transported. The internal components of control means 180 will now be generally described. In this regard, disposed in carrying case 700 is a computerized control assembly, generally referred to as 730, for controllably operating pressurizer means 170. Control assembly 730 comprises a computer 740 having an EPROM (i.e., Erasable Programmable Read Only Memory) semiconductor device 745 therein for automatically controlling the expansion process according to a predetermined computer program (not shown) stored in semiconductor device 745. A toggle switch 747 is provided to activate and deactivate control assembly 730. Control assembly 730 further comprises an audio-visual alarm 750 capable of alerting maintenance personnel to an overpressure condition in system 152 and a light panel 760 having a plurality of lamps 770 thereon capable of emitting light if any or all of the following conditions are sensed by control assembly 730: maximum system pressure, maximum allotted time for the expansion process, system leak, system operating, system not operating, system pressurization as a function of time is too fast, system pressurization as a function of time is too slow, and expansion process is complete. Control assembly 730 also includes a plurality of switches 780 for turning control assembly 730 on and off. In addition, control assembly 730 includes a toggle switch 790 that overrides the computer program for manually stopping the expansion process and a toggle switch 800 that also overrides the computer program for manually prefilling and prepressurizing second chamber 610 with the first hydraulic fluid. Moreover, electrically connected to control assembly 730 by a first wire 810 is a power source (not shown) for supplying electrical power to control assembly 730. Electrically connected to control assembly 730 by a second wire 820 may be visual display means, such as a CRT (i.e., Cathode Ray Tube) 200, for visually representing or displaying the pressure acting on bladder 330, as a function of time during the expansion process. Alternatively, a paper strip recorder (not shown) may be electrically connected to control assembly 730 by a third wire 830 for visually representing or displaying the pressure acting on bladder 330 as a function of time during the expansion process. In addition, pressure transducer 660 is electrically connected to control assembly 730 by a fourth wire 840 for conducting the electrical impulses to control assembly 730 that are produced by transducer 660.

Figure 11:
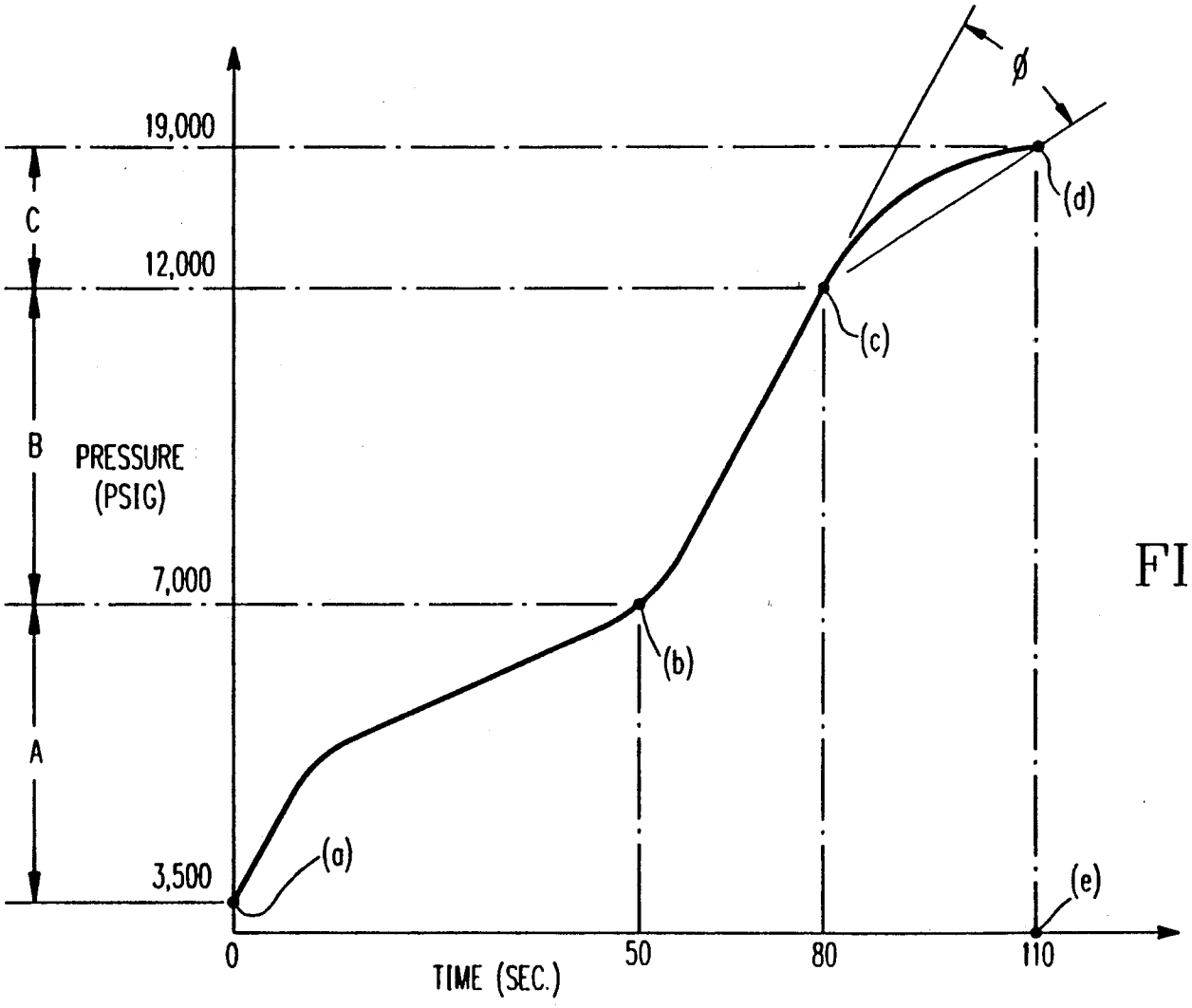
FIG. 11 shows a graph illustrating the pressure acting on the bladder as a function of time during the sleeving process.

Turning to FIG. 11, a typical graph is shown illustrating the hydraulic pressure acting on bladder 330 (and/or bladder 330') as a function of time during the expansion process. As described hereinabove, control means 180 is activated for controllably operating pressurizer means 170 so that pressurizer means 170 controllably pressurizes bladders 330/330'. Prior to the expansion process, the operator of system 152 inputs a value for the "theta shutoff angle $\phi$" into the program stored on EPROM semiconductor device 745 for defining the point (d) appearing on the graph illustrated in FIG. 11. The point (d) predetermines when the expansion process is complete.

As illustrated in FIG. 11, bladder 330 is pressurized in the manner disclosed hereinbelow until point (a) is reached in FIG. 11, whereupon bladder 330 engages inner wall 157 of sleeve 155. Pressurizer means 180 continues to pressurize bladder 330 until point (b) is reached for radially expanding and deforming sleeve 155 elastically through pressure range A as illustrated on the graph in FIG. 11. Pressurizer means 180 continues to pressurize bladder 330 until point (c) is reached in FIG. 11 for radially expanding and deforming sleeve 155 plastically through pressure range B as illustrated on the graph in FIG. 11. As sleeve 155 deforms plastically, it engages inner wall 74 of tube 70 and radially expands and deforms tube 70 plastically through pressure range B, as illustrated on the graph in FIG. 11. When point (c) is reached in FIG. 11, the EPROM semiconductor device 745 belonging to control means 180 begins a step-wise calculation for determining the "shut-off" pressure (i.e., the pressure at point (d)) at which the expansion process is terminated, as described in detail presently. In this regard, EPROM semiconductor device 745 calculates a "reference slope", which is the slope of the pressure curve at point (c). Of course, this reference slope is the first derivative of the pressure curve at point (c) and is a numerical value. Next, as the expansion process continues, EPROM semiconductor device 745 calculates the slope at each point along the pressure curve to obtain an "on-going slope" value for each point on the pressure curve beyond point (c). Of course, the "on-going slope" at each point on the pressure curve is the first derivative of the pressure curve at that point and is a numerical value. The difference between the numerical values for the reference slope and the on-going slope at each point along the pressure curve is defined as the "delta-slope" and is calculated by the EPROM semiconductor device 745. Of course, the delta-slope is also a numerical value. Next, EPROM semiconductor device 745 calculates the arctangent of the delta-slope to obtain a delta-angle "$\phi'$". EPROM semiconductor device 745 then compares this delta-angle "$\phi'$" to the predetermined theta shut-off angle $\phi$. EPROM semiconductor device 745 performs this comparison at each point along the pressure curve. When the delta-angle "$\phi'$" equals the theta shut-off angle $\phi$, within a predetermined epsilon neighborhood of the theta shut-off angle $\phi$, then EPROM semiconductor device 745 concludes that point (d) has been reached and that the expansion process is complete. After determining that the expansion process is complete, EPROM semiconductor device 745 terminates the expansion process. Applicant has discovered that the value of the "theta shutoff angle $\phi$" input into EPROM semiconductor device 745 is best determined empirically and is a function of such factors as the following: wall thickness and yield strength of tube 70 and sleeve 155, desired speed of the expansion process, and maximum design pressure of system 152 components (e.g., bladders 330/330').

Therefore, it will be understood from the description hereinabove that the numerical values for pressure and time shown in FIG. 11 are representative only. For example, although the pressure and time for point (d) are shown as 19,000 psig at 110 seconds, respectively, the pressure may fall between approximately 16,000 psig and 19,000 psig and the time may be between approximately 40 seconds and 110 seconds, depending on the wall thickness and yield strength of tube 70 and/or sleeve 155 found in a typical steam generator. As another example, although the pressure and time for point (c) are shown as 12,000 psig at 80 seconds, respectively, the pressure may be about 12,000 psig, but the time may be between approximately 30 seconds and 80 seconds. As yet another example, although the pressure and time for point (b) are shown as 7,000 psig at 50 seconds, respectively, the pressure may fall between approximately 4,000 psig and 7,000 psig and the time may be between approximately 20 seconds and 50 seconds.

That is, pressurizer means 180 continues to pressurize bladder 330 until point (d) is reached in FIG. 11 for radially expanding and deforming sleeve 155 plastically through pressure range C, as illustrated on the graph in FIG. 11. The expansion process is automatically stopped by the program stored in EPROM device 475 when the pressure curve reaches point (d) in FIG. 11. When the expansion caused to fall to approximately zero psig, as illustrated by point (e) in FIG. 11, because pressurizer means 170 depressurizes bladder 330 at this point by allowing the fluid to drain from bladder 330.

Figure 12:
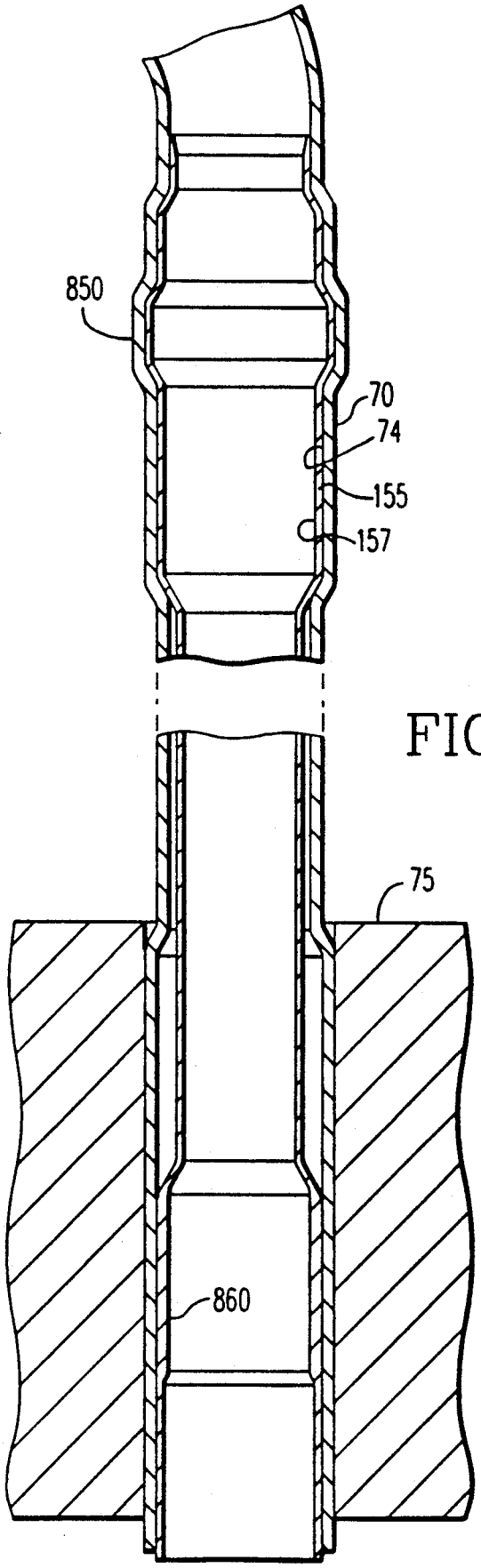
FIG. 12 shows in vertical section, a sleeved tube after the sleeving process has been completed and after the support body and bladder have been withdrawn from the sleeve and tube.

Referring to FIG. 12, sleeve 155 is there shown intimately engaging tube 70 for sleeving a degraded portion of tube 70. In this regard, system 152 has caused sleeve 155 to be swaged or radially expanded into tube 70 at a first expansion zone 850 and at a second expansion zone 860 so that sleeve 155 is securely retained in tube 70 as sleeve 155 spans the degraded portion of tube 70.

Figure 13:
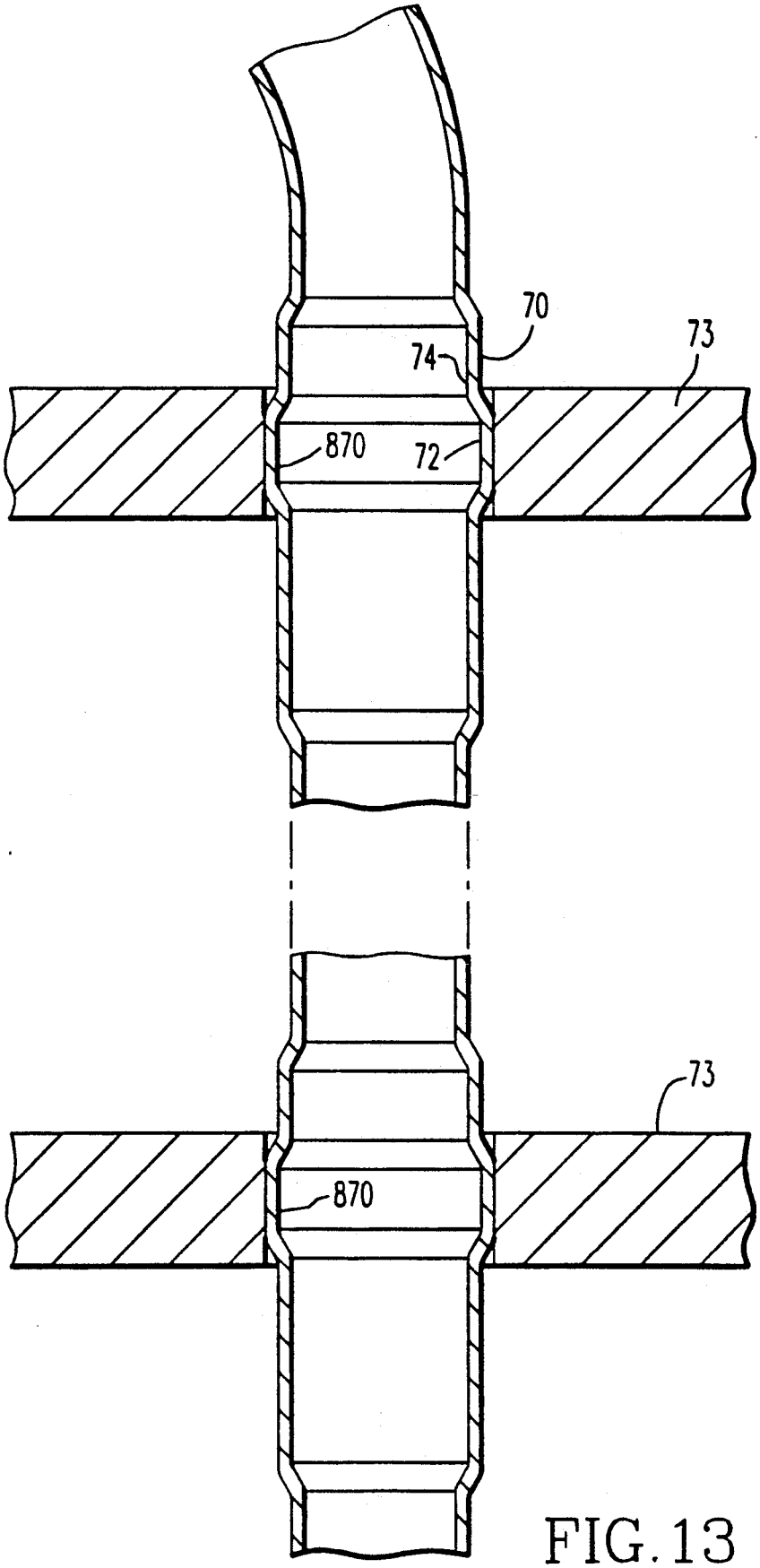
FIG. 13 shows in vertical section, a tube expanded into its surrounding support plates for stabilizing the tube.

Referring to FIG. 13, system 152 has caused tube 70 to be expanded in hole 72 in support plate 73 for stabilizing tube 70. In this regard, tube 70 has been swaged or radially expanded into intimate engagement with support plate 73 at expansion zones 870 so that tube 70 does not experience large-amplitude vibration which might otherwise occur during postulated accident conditions (e.g., loss of coolant accident). It will be appreciated that tube 70 may be similarly expanded into intimate engagement with tube sheet 75 so that tube 70 does not experience large amplitude vibration.

OPERATION

Steam generator 20 is first removed from service in a manner well known in the art and system 152 is transported sufficiently near steam generator 20 for sleeving a selected tube 70 and/or for stabilizing tube 70. The operation of system 152 will be described with respect to sleeving a degraded tube 70 and will then be described with respect to stabilizing tube 70.

With respect to sleeving tube 70, conduit 175 is removably connected to second chamber 610 at one end thereof and to tail connector 438 at the other end thereof for conducting the first hydraulic fluid from pressurizer means 170, through conduit 175 and to expansion means 160. Expansion means 160 is inserted into sleeve 155 and control means 180 is activated to operate pressurizer means 170 such that bladders 330/330' radially expand into engagement with inner wall 157 of sleeve 155. In this regard, valve 647 is opened to allow the first hydraulic fluid to flow from first reservoir 190 through conduit 645 to adaptor fitting 640, which adaptor fitting 640 may have a valved bypass line (not shown) and overflow container (not shown) for providing means for accepting overflow of the first hydraulic fluid. Normally, the bypass line is closed by closing the valve associated therewith. The first hydraulic fluid then flows from adaptor fitting 640 via pipe 630 to second chamber 610 for prefilling chamber 610 and conduit 175 with the first hydraulic fluid. In the manner described hereinbelow, second chamber 610 and conduit 175 are pressurized such that bladders 330/330' are expanded only to the extent necessary to intimately engage inner wall 157 of sleeve 155, but not to an extent that would radially expand sleeve 155. In this manner, sleeve 155 is captured on expansion means 160 and securely held thereto by force of friction without being radially expanded. Bracket 195 and pusher/puller mechanism 192 are suitably connected to manway 120 and guide mechanism 215 is installed in outlet plenum chamber 110. Expansion means 160 is inserted into outlet plenum chamber 110 whereupon it is engaged by guide mechanism 215 for aligning the longitudinal axis of expansion means 160 with the longitudinal axis of tube 70 and for guiding expansion means 160 into tube 70. The wheels 210 of pusher/puller mechanism 192, which are caused to engage conduit 175, rotate so that expansion means 160 advances to a predetermined axial location within tube 70 where tube 70 is degraded.

When expansion means 160 reaches the desired axial location within tube 70, the rotation of wheels 210 belonging to pusher/puller mechanism 192 is stopped and pressurizer means 170 is operated by control means 180 such that bladders 330/330' are radially expanded to radially expand sleeve 155 into intimate engagement with tube 70. In this regard, pump 500 withdraws the second hydraulic fluid from second fluid reservoir 191 and pumps the second hydraulic fluid through pipe 520 to filter 510. The fluid then flows through pipe 555 to manifold block assembly 550, which in turn supplies this fluid to second solenoid valve 570. Second solenoid valve 570 controllably supplies this fluid through pipe 565 to flow control valve 567, which flow control valve 567 may be controlled by semiconductor device 745. The second hydraulic fluid then flows through control valve 567 to first chamber 590 which belongs to pressure intensifier 580. This second hydraulic fluid will enter first chamber 590 when flow control valve 567 is suitably opened. Second solenoid valve 570 and control valve 567 controllably supply the second hydraulic fluid to piston head 605 in first chamber 590 of pressure intensifier 580 for driving piston 600 so that pressure is exerted on the fluid in second chamber 610 to pressurize bladders 330/330'. During prepressurization, the fluid that is caused to flow through conduit 175 enters bore 441 formed in tail connector 438 and flows through channels 310/310' and exits ports 320/320' to pressurize the inner surface of bladders 330/330' so that bladders 330/330' radially expand. The purpose of the prepressurization process is to prefill first chamber 610 and conduit 175 with the first hydraulic fluid as rapidly as possible prior to the start of the slower controlled expansion process which begins at point (a) on FIG. 11. Such rapid prefilling of the first chamber 610 and conduit 175 reduces the total time to complete the entire expansion process. Of course, another purpose of the prepressurization is to secure sleeve 155 to expansion means 160. The prepressurization process will obtain a predetermined terminal pressure, such as approximately 3,500 psig. (see point (a) in FIG. 11). Pressure intensifier 580 is now in operative condition to begin the expansion process. That is, EPROM semiconductor device 745 allows more of the second hydraulic fluid to enter first chamber 590 to further translate piston 605, which in turn further pressurizes the first hydraulic fluid found in second chamber 610 and conduit 175 for expanding bladders 330/330'.

As bladders 330/330, radially expand, ribs 420 (or alternatively ribs 430) belonging to wall portion 380 of bladders 330/330' radially expand to radially expand sleeve 155 into intimate engagement with inner wall 74 of tube 70. The expansion process is continued until a predetermined pressure value is reached, such as the pressure value at point (d) in FIG. 11 for permanently or plastically deforming both sleeve 155 and tube 70 in the expansion zones 850 and 860 (see FIG. 12). At this point (d), the sleeving process is completed and the fluid is caused to drain from expansion means 160 in substantially the reverse order of pressurizing expansion means 160. Next, expansion means 160 is withdrawn from tube 70 in substantially the reverse order of its insertion into tube 70. In this manner, tube 70 is sleeved.

Use of system 152 will now be described with respect to stabilizing tube 70. That is, system 152 is also usable to stabilize a selected tube 70 in addition to sleeving tube 70. In this regard, expansion means 160 is inserted into tube 70 as disclosed hereinabove, but without sleeve 155, and pressurizer means 170 is operated to pressurize bladders 330/330' for radially expanding tube 70 into intimate engagement with its surrounding support plate 73 and/or tubesheet 75, so that tube 70 is suitably stabilized. Once stabilized in this manner, tube 70 will not experience large amplitude vibration due to cross-current flow of the secondary fluid during postulated accident conditions (e.g., loss of coolant accident).

By way of example only and not by way of limitation, tube 70 and sleeve 155 may be made of "INCONEL 600", or the like, comprising by weight percent approximately 76.0% nickel, 0.08% carbon, 0.5% manganese, 8.0% iron, 0.008% sulfur, 0.025% copper, and 15.5% chromium for resisting stress corrosion cracking. In its unexpanded state, tube 70 may have an inside diameter of approximately 0.770 inches and an outside diameter of approximately 0.875 inches. In its unexpanded state, sleeve 155 may have an inside diameter of approximately 0.664 inches and an outside diameter of approximately 0.745 inches so that it can be easily coaxially moved within tube 70. In its unexpanded state, expansion means 160 may have a nominal outside diameter at its widest point of approximately 0.655 inches for being easily slidably inserted within sleeve without need for lubrication. The pressures seen by bladders 330/330' during the expansion process may have the pressure values shown in FIG. 11 and the "theta shutoff angle $\phi$" illustrated in FIG. 11 may have a minimum empirically predetermined value of approximately 0.5 degrees and may have a maximum value as large as the design pressure of the expansion system will allow. After the expansion is completed, such an expanded sleeve 155 may have expansion zones 850/860 having a relatively short axial length of approximately 0.6 inches and an inside diameter at its widest point of approximately 0.72 inches. Moreover, after the expansion is completed, such a tube 70 may have corresponding expansion zones 850/860 having a relatively short axial length of approximately 0.6 inches and an outside diameter at its widest point of approximately 1.075 inches.

Although the invention is illustrated and described herein in several embodiments, it is not intended that the invention as illustrated and described be limited to the details shown, because various modifications may be obtained with respect to the invention without departing from the spirit of the invention or the scope of equivalents thereof. For example, ribs 420/430 may extend helically around wall portion 380 rather than extending longitudinally or circumferentially around wall portion 380. Such helically extending ribs may enable wall portion 380 to exert a more evenly distributed force on inner wall 157 of sleeve 155 or on inner wall 74 of tube 70, so that the circumference of the expansion zone is more nearly uniformly round.

Therefore, what is provided is a system and method for hydraulically expanding tubular members, wherein the required axial length of the expansion zone for the tubular member is relatively short.

What is claimed is:

1. A system for expanding a tubular member having an inner wall, comprising:

(a) a support body received in the tubular member, said support body having an exterior surface and a port on the exterior surface;

(b) a bladder connected to said support body and covering the port, said bladder having a corrugated wall portion for strengthening said bladder;

(c) pressurizer means connected to the port for supplying fluid to said bladder for radially expanding said bladder into engagement with the inner wall of the tubular member; and (d) a computer connected to said pressurizer means for controlling said pressurizer means, whereby said bladder controllably expands the tubular member as said bladder radially expands into engagement with the inner wall of the tubular member.

2. The system according to claim 1, further comprising a plurality of ribs forming the corrugated wall portion of said bladder, so that said bladder expands without rupture.

3. A system for hydraulically expanding a tubular member having an inner wall, comprising:

(a) a support body sized to be received in the tubular member, said support body having an exterior surface and an interior channel terminating in a port on the exterior surface for conducting fluid to the exterior surface;

(b) a resilient bladder surrounding the exterior surface of said support body for expanding the tubular member, said bladder having a corrugated wall portion for strengthening said bladder;

(c) pressurizer means connected to the channel for supplying the fluid into the channel and through the port to pressurize said bladder and for withdrawing the fluid through the port and from the channel to depressurize said bladder; and (d) a computer connected to said pressurizer means for controllably operating said pressurizer means, whereby said pressurizer means supplies the fluid into the channel and through the port to pressurize said bladder and withdraws the fluid through the port and from the channel to depressurize said bladder as said control means operates said pressurizer means and whereby said bladder expands to intimately engage the inner wall of the tubular member as said bladder is pressurized and contracts to disengage the inner wall of the tubular member as said bladder is depressurized so that the tubular member is expanded thereby.

4. The system according to claim 3, further comprising a plurality of adjacent parallel ribs forming the corrugated wall portion of said bladder for strengthening said bladder, so that said bladder expands without rupture.

5. The system according to claim 4, wherein said bladder is a thermo elastomer, so that said bladder is resilient.

6. In a heat exchanger having a plurality of heat transfer tubes disposed therein, each of the tubes having an inner wall, a system for hydraulically radially expanding a wall portion of a selected one of the tubes, comprising:

(a) an elongate support body sized to be received in the tube, said support body having a proximal end portion and a distal end portion and an exterior surface, said support body having an interior channel extending from the proximal end portion and terminating in a port on the exterior surface of said support body for conducting hydraulic fluid to the exterior surface;

(b) a generally tubular resilient bladder circumscribing said support body for radially expanding the wall portion of the tube, said bladder having a proximal end portion and a distal end portion, the proximal end portion and the distal end portion each being sealingly connected to said support body so that said bladder is leak-tight, said bladder having a corrugated wall portion having an inner surface disposed over the port and an outer surface disposed adjacent the inner wall of the tube for intimately engaging the inner wall of the tube, said bladder and said support body defining a variable volume space therebetween;

(c) pressurizer means hydraulically connected to the channel for supplying the fluid to the channel, through the port and into the space to pressurize the inner surface of said bladder so that said bladder radially expands and for withdrawing the fluid from the space, through the port and from the channel to depressurize the inner surface of said bladder so that said bladder radially contracts;

(d) a computer connected to said pressurizer means for controlling said pressurizer means, said computer including an erasable programmable read only memory semiconductor device therein for automatically controllably operating said pressurizer means and for automatically stopping the expansion of said bladder, whereby said pressurizer means controllably supplies the fluid into the channel, through the port and into the space so that the inner surface of said bladder is pressurized thereby, whereby said pressurizer means controllably withdraws the fluid from the space, through the port and from the channel so that the inner surface of said bladder is depressurized thereby and whereby said bladder radially expands to intimately engage the inner wall of the tube to radially expand the tube as said bladder is pressurized and radially contracts to disengage the inner wall of the tube as said bladder is depressurized; and (e) visual display means for visually displaying the pressure as a function of time acting on the inner wall of said bladder as said bladder is pressurized and depressurized.

7. The system according to claim 6, further comprising a plurality of adjacent parallel ribs forming the corrugated wall portion of said bladder on the outer surface of the wall portion for strengthening said bladder, so that said bladder expands without rupture.

8. The system according to claim 7, wherein said bladder is a thermo elastomer, so that said bladder is resilient.

9. The system according to claim 8, wherein each of said ribs extends along the corrugated wall portion of said bladder and parallel to the inner wall of the tube.

10. The system according to claim 8, wherein each of said ribs circumscribes said bladder.

11. The system according to claim 6, wherein said pressurizer means comprises a conduit extending from said pressurizer means to the channel in said support body for supplying the fluid to the channel so that said pressurizer means in hydraulically connected to the channel.

* * * * *